US005576591A

United States Patent [19]

Block et al.

[11] Patent Number: 5,576,591

[45] Date of Patent: Nov. 19, 1996

[54] GAS DISCHARGE LAMP HAVING A TRANSPARENT ENVELOPE BULK AND A BURSTING GUARD

[75] Inventors: Werner Block, Taufkirchen; Holger Claus, Pfaffing, both of Germany

[73] Assignee: BLV Licht-und Vakuumtechnik GmbH, Steinhoring, Germany

[21] Appl. No.: 241,906

[22] Filed: May 12, 1994

[30] Foreign Application Priority Data

May 24, 1993 [DE] Germany ..... 43 17 252.0

[51] Int. Cl.[6] ..... H01K 1/34; H01J 61/34

[52] U.S. Cl. ..... 313/25; 313/580; 313/634

[58] Field of Search ..... 313/25, 580, 634, 313/635, 579; 362/183, 377, 186

[56] References Cited

U.S. PATENT DOCUMENTS

| | | | |
|---|---|---|---|
| 4,625,140 | 11/1986 | Gagnon | 313/25 |
| 4,721,876 | 1/1988 | White et al. | 313/25 |
| 4,888,517 | 12/1989 | Keeffe et al. | 313/25 |
| 4,942,330 | 7/1990 | Kariotaki et al. | 313/25 |
| 4,950,938 | 8/1990 | Ramaiah | 313/25 |

FOREIGN PATENT DOCUMENTS

| | | |
|---|---|---|
| 0361530 | 4/1990 | European Pat. Off. . |
| 0173235 | 6/1991 | European Pat. Off. . |
| 0186899 | 7/1991 | European Pat. Off. . |

*Primary Examiner*—Sandra L. O'Shea
*Assistant Examiner*—Vip Patel
*Attorney, Agent, or Firm*—Keck, Mahin & Cate

[57] ABSTRACT

The invention relates to a gas discharge lamp having a gas discharge tube, which is at least partly surrounded by a transparent protective bulb, the latter having a bursting guard. The protective bulb is designed as a completely closed envelope bulb, which surrounds in vacuum-tight manner the gas discharge tube. The bursting guard also completely envelops the envelope bulb.

17 Claims, 2 Drawing Sheets

GAS DISCHARGE LAMP HAVING A TRANSPARENT ENVELOPE BULK AND A BURSTING GUARD

FIELD OF THE INVENTION

The invention relates to a gas discharge lamp having a gas discharge tube, which is at least partly surrounded by a transparent protective bulb and with a bursting guard located around the protective bulb.

BACKGROUND OF THE INVENTION

In view of the ever-stricter safety regulations concerning lamps and in particular gas discharge lamps, which are intended for open lighting units, i.e. units without any protective glass in front of the lamp, the requirement exists that throughout the life of such lamps a completely safe and reliable operation is ensured. In the case of such lamps the very limited risk exists that the gas discharge tube present in the gas discharge lamp will burst during operation. In such a case glass splinters could shatter the surrounding gas discharge lamp bulb and possibly endanger persons or materials.

It must therefore be ensured with such gas discharge lamps, that the outer bulb thereof does not break. However, even in the case of lamps having protective glass there is a very limited risk that splinters emanating from the lamp will shatter said protective glass.

A lamp of the aforementioned type, whose design already partly takes account of problems of the aforementioned type is known from U.S. Pat. No. 4,721,876. The gas discharge lamp described in this document has an inner envelope bulb, which is designed as a cylindrical bulb open on two sides or as a dome-like bulb open on one side and having a relatively thick cylindrical wall. This known envelope bulb is surrounded by a wire gauze or grid. The gas discharge tube, including the envelope bulb and wire gauze, are encapsulated in vacuum-tight manner with respect to the outside in a glass bulb.

Apart from the fact that this solution is unfavorable for various metal vapour lamps, because the wire gauze can influence the electrical potential of the lamp and can therefore lead to an increased sodium loss and therefore to a shorter life, the envelope bulb is open on at least one side. This leads to the high risk of splinters passing through the open end of the envelope bulb in the case of the gas discharge tube bursting and might even shatter the outer bulb. In this known lamp there is also no UV-protection.

A lamp comparable with that described hereinbefore is known from EP 361 530 A or U.S. Pat. No. 4,942,330. For protection against bursting or shattering of the gas discharge tube said lamp has a transparent plate, which is constructed as a cylinder open on both ends and which is surrounded by a net of ceramic fibres. These ceramic fibres are intended to have an adequate strength to ensure that if a gas discharge device bursts, splinters can be held back if the plate breaks.

Apart from the fact that the plate is open at both ends, a serious disadvantage is represented by the fact that the ceramic net is difficult to manufacture and difficult to place around the plate. Moreover, the plate, in conjunction with the ceramic net, reduces the light flux of the lamp.

In a gas discharge lamp according to EP 186 899 B1 , the bursting protection is constituted by a cylindrical element in the form of a quartz sleeve. An outer holding wire is provided for the precise positioning thereof around the gas discharge tube, but no shattering protection is provided.

Further quartz bulbs closed on one side and placed around the gas discharge tube are known from EP 173 235 B1or 165 587 B1. The envelope bulbs open at one side provided therein are primarily used for the thermal operating conditions of the lamp, because the open end of the envelope bulb cannot offer a protection against splintering with respect to the outside and there is no other splintering protection means around the envelope bulb.

Other measures intended to ensure increased safety in the case of gas discharge lamps are cylindrical envelope bulbs with a wall thickness of 2 mm and more, but these are at least open on one side and usually on both sides. A further possibility are two telescoped quartz glass protective tubes, which surround the gas discharge tube, a UV-filter being applied to one protective tube.

Another problem with gas discharge lamps is the necessary UV-protection which such lamps must have, i.e. the emitted radiation in the UVC, UVB and UVA ranges must be at least limited to specific, prescribed values.

The known gas discharge lamps use UV-filters applied by sputtering or dipping. This application of the UV-filter normally takes place to the inner envelope bulb or to the outer glass bulb. However, these solutions suffer from the disadvantage that such applied filters undergo changes to their characteristics during the life of the lamps. In addition, the transmission characteristics of these UV-filters are highly dependent on the light incidence angle and the temperature of the filter coating applied.

SUMMARY OF THE INVENTION

Taking account of the above disadvantages, the main object of the invention is to so constructionally improve a gas discharge lamp of the aforementioned type, that in constructionally simple manner an optimum protection against the bursting of the outer lamp tube is provided, without impairing the life of the lamp or its luminous efficiency.

According to the invention, this object is achieved with a gas discharge lamp, which has a gas discharge tube, which is at least partly surrounded by a transparent, translucent or light-transmitting protective bulb and has a bursting guard placed around the protective bulb, the latter being constructed as a completely closed envelope bulb, which surrounds in vacuum-tight manner the gas discharge tube and the bursting guard is located on the envelope bulb and completely envelopes the latter.

An essential idea of the invention is that the protective bulb surrounding the gas discharge tube is designed as a completely closed envelope bulb, so that there is a complete encapsulation of the gas discharge tube and the envelope bulb is placed in vacuum-tight manner around the same. This ensures that if the gas discharge tube bursts at no point can splinters pass to the outside, unless the splinters pass through the envelope bulb.

In order to protect the envelope bulb against this, the bursting guard is positioned in such a way that it completely envelops the envelope bulb. Thus, if the envelope bulb should shatter at the time of the bursting of the gas discharge tube, then the shattered glass parts of the envelope bulb are retained by the bursting guard.

This construction of the gas discharge lamp makes it possible to obtain an optimum bursting protection for the smallest possible external diameter of the envelope bulb. In an appropriate design of the gas discharge lamp with a contact or screw cap, the possibility consequently exists of inserting said lamp in a standardized safety holder of the type used for gas discharge lamps secured against shattering. This would be prevented by the convex outer bulb in the case of the above-discussed prior art lamps.

The vacuum-tight encapsulation of the gas discharge tube by the envelope bulb also ensures that the bursting guard cannot cause any potential influencing of the discharge tube and therefore in any way impair the life of the lamp.

Preferably the bursting guard is made from a high-melting material. It is particularly appropriate to use a metal wire with a diameter of <0, 12 mm and a wire spacing or mesh width of <2 mm.

The bursting guard could also be in the form of a glass fibre net or a net made from Teflon fibres or high-melting, non-conductive plastic fibres.

It is particularly advantageous to incorporate the UV-filter directly into the envelope bulb in the sense of a volume filter. For this purpose the envelope bulb is made from quartz glass or tempered glass, containing specific admixtures of materials, which are in particular UVB and UVC-absorbing. The quartz glass can be designed in such a way that the wavelengths of the light in the range of 350 nm and below are largely absorbed and there is only a transmission of <5%. In this way it is possible to absorb UVB and UVC-rays to approximately 95% and UVA-rays to approximately 30%.

The further advantage of this volume-filter is that no exit region for UV-radiation is left open, because the envelope bulb completely encapsulates the gas discharge tube. The long-term action with respect to the filter coatings applied or the light incidence angle can be ignored with this volume filter. Such an envelope bulb volume filter consequently has an independent inventive character.

A further improvement to the gas discharge lamp can be obtained with an outer protective bulb. Such a protective bulb surrounds the envelope bulb, both bulbs being fixed by means of a non-conductive adaptor, preferably made from a ceramic or plastics material, to a screw cap. This outer protective bulb consequently provides security against any trickling down of very small glass particles, which could be released if the gas discharge tube burst. The protective bulb surrounds the envelope bulb under environmental pressure, so that there is no underpressure or overpressure between said two bulbs.

A gas discharge lamp of the aforementioned type can be equipped with a plug-in or screw cap. The current supply or lead-in wires can be located on one or more sides. In particular, these important improvements can be provided in the case of a metal vapour lamp.

Thus, compared with the prior art the invention adopts a completely new procedure, in that on the one hand the envelope bulb encapsulates in vacuum-tight manner the gas discharge tube. In addition, the problem of UV-filtering through the corresponding material is solved, which then functions as a closed tube or vessel in the sense of a uniformly and constantly strongly absorbing volume filter.

BRIEF DESCRIPTION OF THE DRAWINGS

The invention is described in greater detail hereinafter relative to two embodiments and with reference to the attached drawings, wherein show.

DETAILED DESCRIPTION OF THE INVENTION

Figure 1:
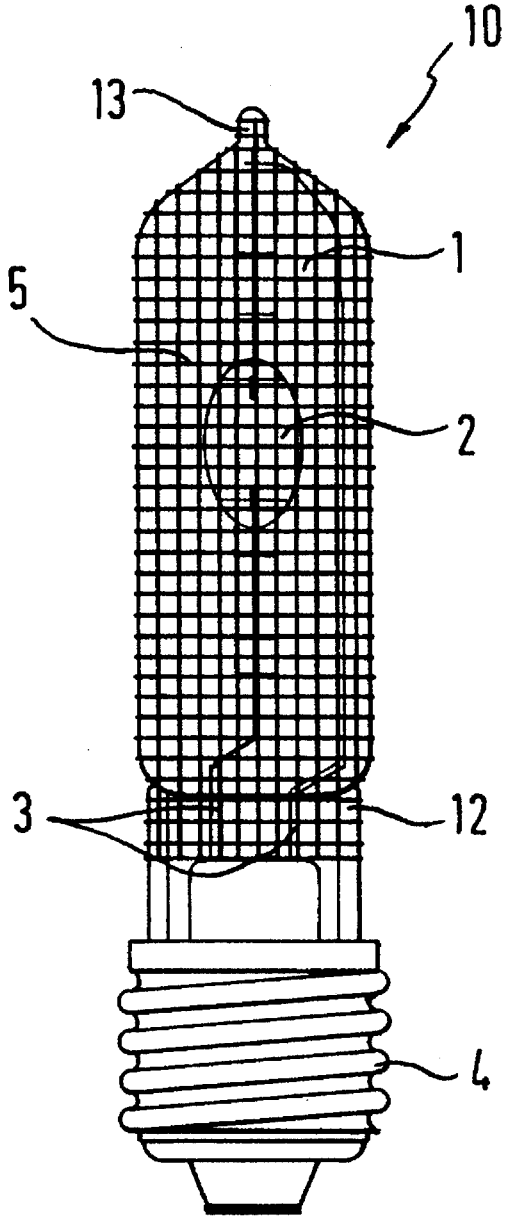
FIG. 1 A front elevation of a first embodiment having an envelope bulb with a bursting guard.

The gas discharge lamp 10 shown in FIG. 1 has an internal gas discharge tube 2, which is sealed in vacuum-tight manner into an envelope bulb 1. In its lower area the envelope bulb 1 has a pinched base 12 through which the lead-in wires 3 are passed via two outer areas into the screw cap 4. At the upper end the envelope bulb 1 is melted together in a slightly sloping tapering form (at 13).

A bursting guard 5 in the form of a metal grid or net is applied to the envelope bulb 1. This bursting guard extends from the upper tip 13, where it can e.g. be shrunk together, to the lower pinched zone 12, without there being any electrical influencing of the lead-in wires to the two-sided gas discharge tube.

The envelope bulb 1 is made from a UV-absorbing quartz glass, which functions as a volume filter for the absorbtion of wavelengths, particularly below 330 nm.

The net-like bursting guard is in particular fitted in closely engaging manner to the envelope bulb 1, it also being possible for the lower area to be melted on in punctiform or complete manner. Thus, the bursting guard, even in the rare case of the destruction of the gas discharge tube 2 or the envelope bulb 1, prevents any dropping out or down of large glass particles onto people or flammable materials, so that optimum safety is ensured.

Figure 2:
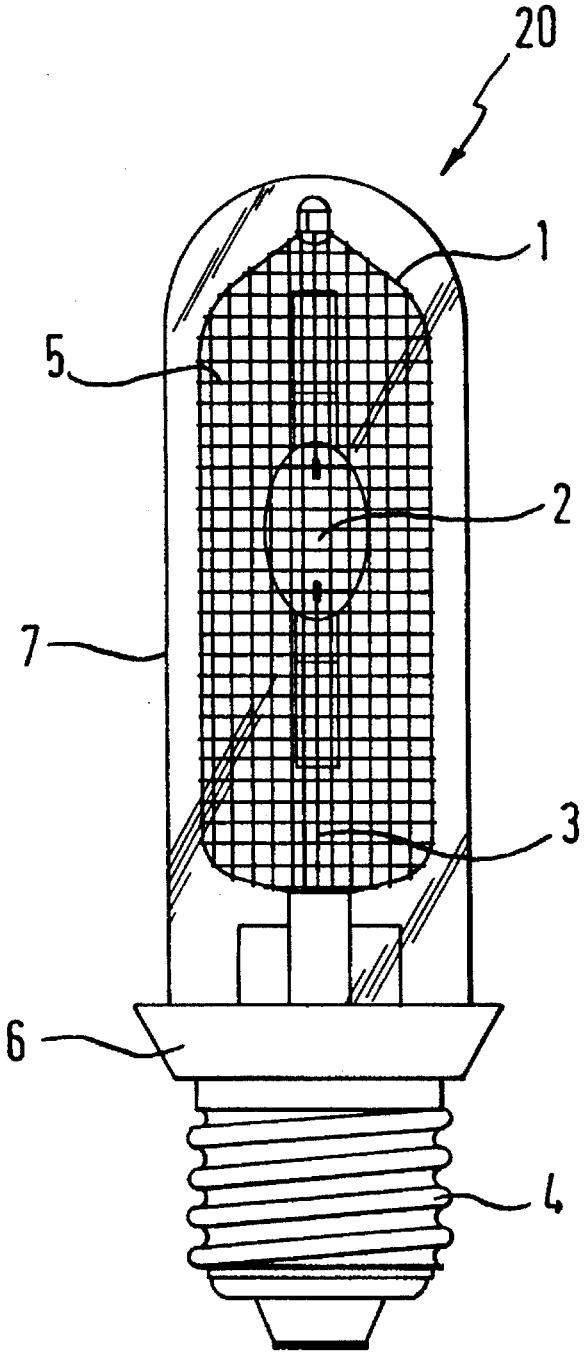
FIG. 2 A front elevation of a lamp comparable with FIG. 1, but which has an outer protective bulb.

In the embodiment according to FIG. 2 the gas discharge lamp 20 has, in addition to the lamp 10 of FIG. 1, an outer protective bulb 7, e.g. made from tempered glass. This outer protective bulb 7 and the inner envelope bulb 1 are fitted in a ceramic adaptor 6, which passes into the screw cap 4. This protective bulb 7 is closed on one side, so that atmospheric pressure prevails between the protective bulb 7 and the inner envelope bulb 1 or the bursting guard 5. Thus, even in the case of the shattering of the inner envelope bulb, the protective bulb 7 prevents a trickling down of very small particles, so that the gas discharge lamp 20 offers an even further extending safety.

Whilst taking account of the necessary bursting protection and the high UV-absorbtion, the invention consequently provides an extremely inexpensive, long-life gas discharge lamp, which ideally complies with all conceivable safety requirements.

What is claimed is:

1. A gas discharge lamp comprising:

a) a gas discharge tube containing light-emitting gas;

b) a transparent envelope, b1) which is constructed as a completely closed envelope bulb having a closed upper tip and a lower pinched base, b2) said gas discharge tube is encapsulated in said closed envelope bulb in vacuum-tight manner;

c) lead-in wires for said gas discharge tube, said lead-in wires passing into said closed envelope bulb through said lower pinched base;

d) a net-like bursting guard, d1) which is applied on said envelope bulb and extends from said closed tip to said pinched lower base, wherein said closed envelope bulb is completely covered by said bursting guard, d2) said bursting guard is melted on said closed envelope bulb at least at the lower pinched base; and e) contact means for providing electrical energy to said gas discharge tube via said lead-in wires.

2. A gas discharge lamp according to claim 1, wherein the bursting guard (5) is made from high-melting material.

3. A gas discharge lamp according to claim 2, wherein the bursting guard (5) is formed from metal wire having a wire diameter of less than 0.12 mm and a wire spacing of less than 2 mm.

4. A gas discharge lamp according to claim 1, wherein the bursting guard (5) is made from glass fibres.

5. A gas discharge lamp according to claim 1, having a screw cap, wherein the maximum diameter or maximum width of the envelope bulb (1) is equal to or smaller than the diameter of the screw cap (4).

6. A gas discharge lamp according to claim 5, wherein the maximum diameter or the maximum width of the envelope bulb (1) is 31 mm.

7. A gas discharge lamp according to claim 1, wherein the lead-in wires are provided on one side.

8. A gas discharge lamp according to claim 1, wherein the lamp is a metal vapour lamp.

9. A gas discharge lamp according to claim 1, wherein the bursting guard (5) is made from Teflon fibres.

10. A gas discharge lamp according to claim 1, wherein the bursting guard (5) is made from high-melting plastic fibres.

11. A gas discharge lamp according to claim 1 wherein the envelope bulb (1) is made from tempered glass.

12. A gas discharge lamp according to claim 1, wherein the lead-in wires are provided on two sides.

13. A gas discharge lamp comprising:

a) a gas discharge tube containing light-emitting gas;

b) a transparent envelope, b1) which is constructed as a completely closed envelope bulb having a closed upper tip and a lower pinched base, b2) said gas discharge tube is encapsulated in said closed envelope bulb in vacuum-tight manner, b3) said closed envelope bulb is made from UV-absorbing glass;

c) lead-in wires for said gas discharge tube, said lead-in wires passing into said closed envelope bulb through said lower pinched base;

d) a net-like bursting guard, d1) which is applied on said envelope bulb and extends from said closed tip to said pinched lower base, wherein said closed envelope bulb is completely covered by said bursting guard, d2) said bursting guard is melted on said closed envelope bulb at least at the lower pinched base; and e) contact means for providing electrical energy to said gas discharge tube via said lead-in wires.

14. A gas discharge lamp according to claim 13, wherein the quartz glass has a transmission of less than 5% for wavelengths equal to or smaller than 350 nm.

15. A gas discharge lamp according to claim 13, wherein the tempered glass has a transmission of less than 5% for wavelengths equal to or below 350 nm.

16. A gas discharge lamp comprising:

a) a gas discharge tube containing light-emitting gas;

b) a transparent envelope, b1) which is constructed as a completely closed envelope bulb and having a close upper tip and a lower pinched base, b2) said gas discharge tube is encapsulated in said closed envelope bulb in vacuum-tight manner;

c) lead-in wires for said gas discharge tube, said lead-in wires passing into said closed envelope bulb through said lower pinched base;

d) a net-like bursting guard, d1) which is applied on said envelope bulb and extends from said closed tip to said pinched lower base, wherein said closed envelope bulb is completely covered by said bursting guard, d2) said bursting guard is melted on said closed envelope bulb at least at the lower pinched base;

e) connection means for providing electrical energy to said gas discharge tube via said lead-in wires; and f) a protective bulb mounted on said connection means, f1) whereby said envelope bulb is enclosed by said protective bulb, and f2) ambient pressure prevails between said envelope bulb and said protective bulb.

17. A gas discharge lamp according to cliam 16 wherein a ceramic material adaptor (6) is provided in which are fitted the envelope bulb (1) and the protective bulb (7).

* * * * *